United States Patent [19]

Jackson et al.

[11] Patent Number: 5,007,181

[45] Date of Patent: Apr. 16, 1991

[54] DEAGGLOMERATING DIRECT-FIRED FLASH DRYER FOR DRYING STIR-IN PHOSPHORS AND METHOD OF USING SAME

[75] Inventors: Douglas M. Jackson, Monroeton; John A. Arbie, Sr., Towanda, both of Pa.

[73] Assignee: GTE Products Corporation, Stamford, Conn.

[21] Appl. No.: 473,778

[22] Filed: Jan. 22, 1990

[51] Int. Cl.[5] ..... F26B 17/00

[52] U.S. Cl. ..... 34/57 R; 34/60; 34/102

[58] Field of Search ..... 34/226, 79, 58, 102, 34/57 R, 60, 236; 210/787

[56] References Cited

U.S. PATENT DOCUMENTS

| | | | |
|---|---|---|---|
| B 345,390 | 1/1975 | Demarest et al. | 252/301.4 P |
| 4,407,720 | 10/1983 | Bratten | 210/777 |
| 4,430,231 | 2/1984 | Bratten | 210/783 |
| 4,481,108 | 11/1984 | Bratten | 210/387 |

*Primary Examiner*—Henry A. Bennet
*Assistant Examiner*—Denise L. F. Gromada
*Attorney, Agent, or Firm*—L. Rita Quatrini; Robert E. Walter

[57] ABSTRACT

A method for making stir-in type halophosphate phosphors to obtain a fluffy, deagglomerated powder is disclosed. A wet phosphor filter cake is fed into a toroidal-shaped direct-fired glass flash dryer in which a hot gaseous stream is circulating. The wet phosphor particles are suspended in the stream while the remaining liquid is evaporated. The dried phosphor powder is ejected from the dryer by centrifugal force and collected. Recovery efficiency of the process is about 99.9 percent.

9 Claims, 1 Drawing Sheet

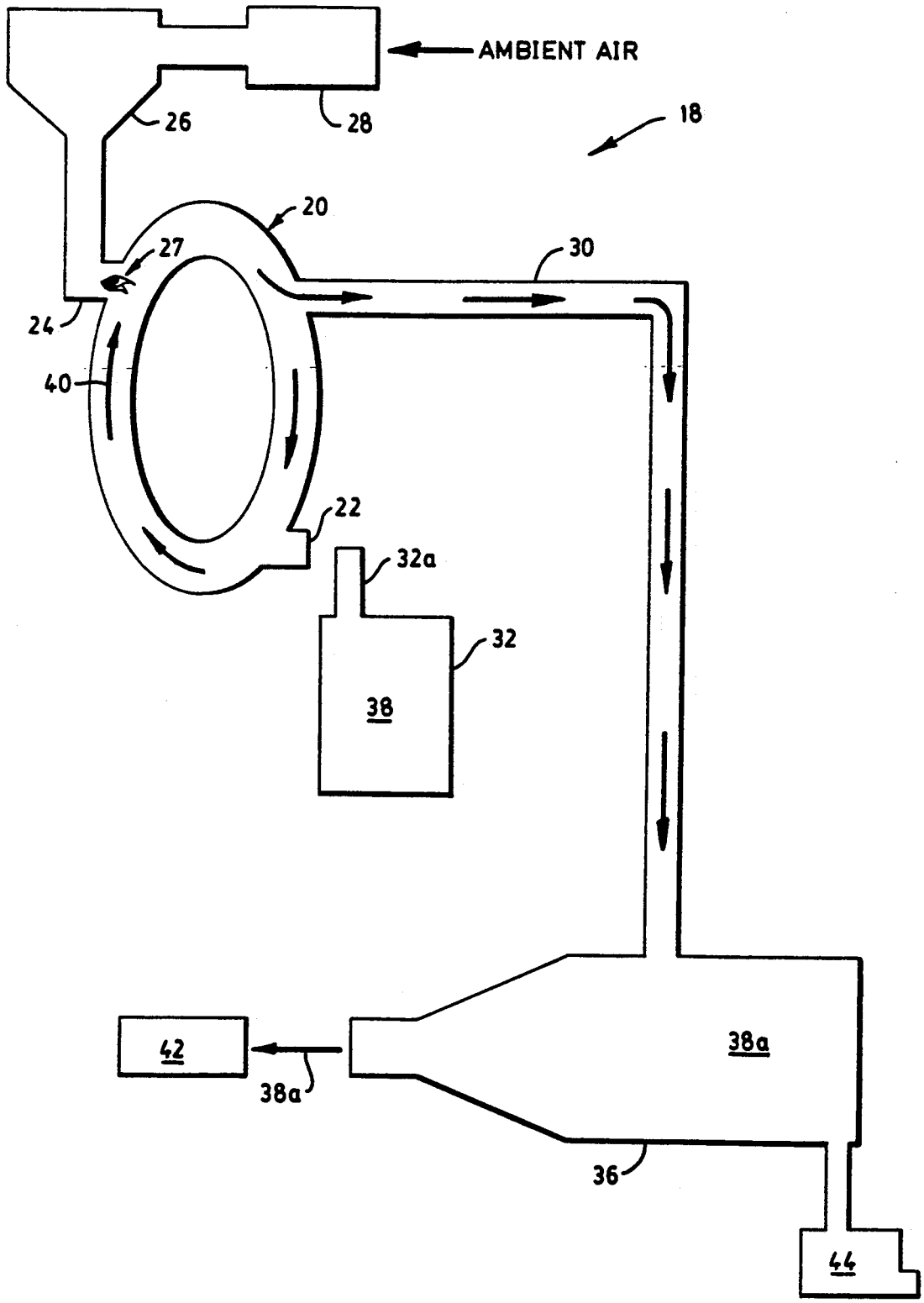
AMBIENT AIR
18
26
28
20
27
30
24
40
22
32a
32
38
42
38a
38a
36
44

DEAGGLOMERATING DIRECT-FIRED FLASH DRYER FOR DRYING STIR-IN PHOSPHORS AND METHOD OF USING SAME

TECHNICAL FIELD

This invention relates to the manufacture of stir-in type halophosphate phosphors.

BACKGROUND ART

Preparation of halophosphate phosphor to obtain a deagglomerated powder is known. U.S. Pat. Nos. 3,654,173 and 3,654,174 to Thomas et al disclose a method of making such a phosphor whereby during synthesis the phosphor particles are maintained in continuous motion or agitation to prevent substantially any agglomeration thereof.

U.S. Pat. application No. B 345,390 to Demarest et al discloses a method of making such a phosphor whereby deagglomeration of the phosphor crystals occurs by high-shear mechanical stirring of the phosphor in an aqueous slurry.

U.S. Pat. No. 3,023,339 to Vodoklys discloses a method of making such a phosphor whereby an aqueous slurry containing the phosphor is fed into a spray dryer, where it is atomized in a hot gas or air stream and exposed to temperatures well above the boiling point of water to rapidly evaporate the water, leaving a fluffy, deagglomerated phosphor powder. The gas or air stream is heated indirectly to about 600° F. (316° C.). The dried phosphor and evaporated water are fed into a conventional centrifugal separator, or cyclone collector. The air stream is forced into a circular path and deposits a substantial portion of the phosphor powder via centrifugal forces in the bottom of the cyclone collector. Residual phosphor dust remaining in the circulating stream is collected in a dust collecting bag, while the circulating stream is vented to the atmosphere. Recovery efficiency of the process is about 95 percent.

SUMMARY OF THE INVENTION

It is an object of the invention to provide an improved method for making stir-in halophosphate phosphors to form a fluffy, deagglomerated powder. The advantage of this invention over the prior art is that the recovery efficiency of this method is 99.9 percent, because virtually all of the phosphor powder is collected from the dryer. Also, drying temperatures can be significantly lower than those of the prior art. The use of nonmetallic materials in the drying chamber also prevents metal contamination during drying.

This object is accomplished, in one aspect of the invention, by preparing a stir-in halophosphate phosphor and drying it in a deagglomerating direct-fired flash dryer comprising a glass toroidal drying chamber; a teflon-coated feeder for transferring a wet phosphor cake from filtering means to the drying chamber; an inlet blower to provide a gaseous stream to the drying chamber for circulation therein; means for heating the gaseous stream; a collector connected by glass conveying means to the drying chamber for collecting the phosphor; and an exhaust fan connected by glass conveying means to the collector to draw the gaseous stream through the drying chamber and the collector.

The phosphor is prepared according to standard practice. Raw materials are blended to form a homogeneous mixture which is then fired, milled in acid, screened, washed with water and treated with a base.

The resultant wet phosphor is then fed through a filter press which removes the liquid phase. U.S. Pat. Nos. 4,407,720, 4,430,231 and 4,481,108 relate to such filtering apparatus. Use of the filter press in line with the flash dryer allows the use of lower temperatures in the flash dryer to evaporate the liquid from the phosphor slurry because the liquid phase is removed in the filter press. The wet filter cake is then fed into the drying chamber of the flash dryer by means of a teflon-coated auger where it is suspended in a circulating hot gaseous stream which dries the phosphor to a fluffy, deagglomerated powder that requires no further classification. There is no cyclone collector which separates coarse from fine material. Rather, the centrifugal force imparted to the circulating phosphor causes the powder to be ejected from the drying chamber when dry. Thus, the recovery efficiency of this flash drying process is 99.9 percent because virtually all of the deagglomerated phosphor is collected and usable. There is no metal contamination of the final phosphor powder because all interior parts of the dryer are lined with either glass, teflon, rubber or other non-metallic material. The dried phosphor powder may optionally be conveyed from the collector to packaging means.

BRIEF DESCRIPTION OF THE DRAWING

FIG. 1 is a schematic representation of a direct-fired flash dryer.

DETAILED DESCRIPTION OF THE INVENTION

The flash dryer 18 is comprised of a hollow glass toroidal chamber 20 having one inlet 22 for introduction of the wet phosphor filter cake 38 from filter press 32 by means of feeder 32*a*, a second inlet 24 for the introduction of a gas-fired flame 27 from burner 26 and a gaseous stream 40 from blower 28 to which ambient air is supplied, and glass conveying means 30 leading to a phosphor collector 36, which catches the dried phosphor powder 38*a*. An exhaust fan 44 attached to the collector 36 draws the dried phosphor powder 38*a* from the flash dryer 18 to the collector 36 by creating a negative pressure within the drying chamber 20. The dried phosphor 38*a* so collected may optionally be sent to packaging means 42. The drying chamber 20 can be made of any nonmetal material, preferably glass, to avoid metal contamination of the phosphor. The phosphor collector 36 can be made of, or lined with, any nonmetal material, such as, for example, glass, rubber or teflon.

The toroidal chamber is formed from a high-temperature, shock-resistance glass tube having an inside diameter of about 4 inches (102 mm) and a wall thickness of about 0.16 to 0.37 inches (4 to 9.5 mm). The chamber can be of any dimension but is preferably about 8¼ to 9 inches (210 to 229 mm) in diameter. A single natural gas burner is used. The phosphor inlet opening may have the same diameter as the glass tube forming the toroidal chamber, preferably about 4 inches (102 mm) in diameter. The exit opening may be larger, preferably about 6 inches (152 mm) in diameter.

The gaseous stream is drawn through the drying chamber by means of an inlet blower and an exhaust fan. The inlet blower operates at 30 horsepower and 3550 rpm. The exhaust fan operates at 30 horsepower and 1800 rpm. The gaseous stream thus moves through the drying chamber at about 4500 cubic feet per minute (cfm) ar 240° F. The gaseous stream may be air or any other gas, but air is preferred because of its availability and low cost. The gas is heated to a temperature just higher than the evaporation temperature of the liquid in the slurry. If water, the preferred liquid, is used in the slurry, the gas is heated to a temperature of not more than 250° F. (121° C.). The gas is directly heated by a natural gas flame from the burner. The gaseous stream circulating in the drying chamber thus comprises the combusition products of the burning gas and the gas itself.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improved direct-fired flash dryer for drying stir-in halophosphate phosphor to a deagglomerated state, comprising:

a glass toroidal drying chamber;

a teflon-coated feeder for transferring a wet phosphor cake from filtering means to said drying chamber;

an inlet blower to provide a gaseous stream to said drying chamber for circulation therein;

means for heating said gaseous stream;

a phosphor collector connected by glass conveying means to said drying chamber for collecting said phosphor; and and exhaust fan connected by glass conveying means to said collector to draw said gaseous stream through said drying chamber and said collector.

2. A flash dryer as in claim 1 wherein said glass is high-temperature shock-resistant glass.

3. A flash dryer as in claim 1 wherein said heating means comprises a single natural gas direct-flame burner.

4. A flash dryer as in claim 1 wherein said gaseous stream is air.

5. A flash dryer as in claim 1 wherein said phosphor collector is lined with teflon.

6. A flash dryer as in claim 1 wherein said phosphor collector is lined with glass.

7. A flash dryer as in claim 1 wherein said phosphor collector is lined with rubber.

8. A flash dryer as in claim 4 wherein said air is heated to a temperature of about 250° F. (121° C.).

9. A flash dryer as in claim 1 wherein said teflon-coated feeder is an auger.

* * * * *